US006730886B2

(12) United States Patent
Cho et al.

(10) Patent No.: US 6,730,886 B2
(45) Date of Patent: May 4, 2004

(54) POWER CONTROL METHOD AND APPARATUS FOR MINIMIZING HEATING TIME INSTANT HEATING ROLLER

(75) Inventors: Durk-hyun Cho, Suwon-si (KR); Joong-gi Kwon, Gunpo-si (KR); Sung-kyung Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 09/933,903

(22) Filed: Aug. 22, 2001

(65) Prior Publication Data

US 2002/0102109 A1 Aug. 1, 2002

(30) Foreign Application Priority Data

Jan. 30, 2001 (KR) ..... 2001-4221

(51) Int. Cl.[7] ..... H05B 1/02
(52) U.S. Cl. ..... 219/497; 219/216; 219/501
(58) Field of Search ..... 219/216, 497, 219/501, 492, 505; 323/369, 238, 908; 340/589

(56) References Cited

U.S. PATENT DOCUMENTS 5,376,773 A 12/1994 Masuda et al.
5,464,964 A * 11/1995 Okuda et al. ..... 219/497
5,621,510 A 4/1997 Okuda et al.
5,627,634 A 5/1997 Koh
5,907,743 A 5/1999 Takahashi
5,994,671 A 11/1999 Suzuki et al.
6,157,010 A * 12/2000 Mine ..... 219/501

FOREIGN PATENT DOCUMENTS

JP 2000-98796 4/2000

OTHER PUBLICATIONS

"*Notice of the reason of rejection*" issued by Korean Industrial Property Office dated on Sep. 28, 2002.

* cited by examiner

*Primary Examiner*—Tu Ba Hoang
(74) *Attorney, Agent, or Firm*—Robert E. Bushnell, Esq.

(57) ABSTRACT

A power control method and an apparatus for an instant heating roller (IHR) include the following steps and functions: (a) determining whether an external source voltage has a first level or a higher second level; (b) when the source voltage has the first level, supplying the source voltage to the heating resistor at intervals of a predetermined time period until the temperature of the heating resistor reaches a target fusing temperature; and (c) when it is determined that the source voltage has the second level, supplying the source voltage to the heating resistor for every half period of the source voltage until the temperature of the heating resistor reaches the target fusing temperature. As the temperature of the heating resistor approaches the target fusing temperature, the predetermined time period is increased in step (b) and the time period of step (c) is decreased. As a result, the power control method and apparatus stably supply source voltage to the heating resistor of the IHR, and achieve other operational advantages.

19 Claims, 9 Drawing Sheets

16
18
T1
T

10%

20%

25%

33%

50%

67%

100%

POWER CONTROL METHOD AND APPARATUS FOR MINIMIZING HEATING TIME INSTANT HEATING ROLLER

CLAIM OF PRIORITY

This application makes reference to, incorporates the same herein, and claims all benefits accruing under 35 U.S.C. §119 from my application METHOD AND APPARATUS FOR CONTROLLING POWER FOR INSTANT HEATING ROLLER filed with the Korean Industrial Property Office on Jan. 30, 2001 and there duly assigned Serial No. 4221/2001.

BACKGROUND OF THE INVENTION

1. Field of the Invention

The present invention relates to an instant heating roller (IHR) for use in toner image fixing, and more particularly, to a power control method and apparatus for supplying an external source voltage to a heating resistor of an IHR.

2. Description of the Related Art

Conventional power control methods for a printing apparatus, such as a printer or copy machine, are disclosed in: U.S. Pat. No. 5,627,634 entitled "Image Fixing Apparatus having a Heater Energized and Controlled by Electric Energy"; U.S. Pat. No. 5,907,743 entitled "Image Heating Apparatus with control for Phase Control of Alternating Current"; and U.S. Pat. No. 5,994,671 entitled "Image Heating apparatus". These conventional power control methods are applied to a film-type driving instant fixing system manufactured by Canon Company (Japan), and can minimize the occurrence of flicker with reduced power consumption.

Other conventional power control methods are disclosed in U.S. Pat. No. 5,376,773 entitled "Heater having Heat Generating Resistors" and U.S. Pat. No. 5,621,510 entitled "Image Heating Apparatus with Driving Roller having Low Thermal Expansion Coefficient Outer Layer".

For the conventional power control methods described above, when the level of external source voltage in the form of alternating current (AC) varies, the roller of the printing apparatus cannot have a consistent fixing characteristic. For example, when the roller of the printing apparatus is an IHR having a heating resistor with a resistance which is in the range of 6–8 Ω for 110–130 volts and a source voltage with a level as high as 180–230 volts, an excessive current flows through the IHR and a power input port to which the AC source voltage is applied, so that the circuit can be damaged by electric shock. In addition, a high AC current flows through the IHR, thereby causing a flicker characteristic to become more severe. The term "flicker characteristic" refers to a temporary drop in power supplied to neighboring circuits.

A conventional power control method capable of improving the flicker characteristic is disclosed in U.S. Pat. No. 5,376,773. However, according to this method, when power applied to the IHR is lower than a predetermined level, the quantity of heat transferred to a pressure roller made of rubber decreases. As a result, it takes much time to reach a target fusing temperature with poor fixing characteristics.

SUMMARY OF THE INVENTION

To address the above limitations, it is a first object of the present invention to provide a power control method for an instant heat roller (IHR) in which consistent power can be applied to the IHR irrespective of the level or frequency of an external source voltage, and in which the IHR can reach a target fusing temperature within a shorter period of time, minimizing the occurrence of overshoot.

It is a second object of the present invention to provide a power control apparatus for an IHR by means of which the power control method is performed.

To achieve the first object of the present invention, there is provided a power control method for an instant heating roller (IHR), and, more particularly, a method for controlling a roller voltage applied to a heating resistor of the IHR, comprising the steps of: (a) determining whether an external source voltage has a first predetermined level or a second predetermined level greater than the first predetermined level; (b) if it is determined that the source voltage has the second predetermined level, supplying the source voltage as the roller voltage to the heating resistor at intervals of a second predetermined time period until the temperature of the heating resistor measured at intervals of a first predetermined time period reaches a predetermined target fusing temperature; and (c) if it is determined that the source voltage has the second predetermined level, supplying the source voltage as the roller voltage to the heating resistor for a third predetermined time period at every half period of the source voltage until the temperature of the heating resistor measured at intervals of the first predetermined time period reaches a predetermined target fusing temperature. Furthermore, as the temperature of the heating resistor approaches the predetermined target fusing temperature, the second predetermined time period is increased in step (b) and the third predetermined time period is decreased in step (c), and the first predetermined time period is equal to or greater than the second predetermined time period.

To achieve the second object of the present invention, there is provided a power control apparatus by means of which the power control method for the IHR is implemented. The apparatus comprises: a power input unit for providing an external source voltage; a voltage determination unit for determining the level of the source voltage input from the power input unit, and for outputting the result of the determination; a temperature measuring unit for measuring the temperature of the heating resistor, and for outputting the measured temperature; a first comparison unit for comparing the measured temperature and the first predetermined temperature, and for outputting the result of the comparison; a second comparison unit for comparing the measured temperature and the predetermined target fusing temperature, and for outputting the result of that comparison; a third comparison unit for comparing the measured temperature and the second predetermined temperature, and for outputting the result of that comparison; a fourth comparison unit for comparing the measured temperature and the third predetermined temperature, and for outputting the result of that comparison; a controller for outputting a power control signal in response to the results of the comparisons from the first, second, third, and fourth comparison units, and the result of the determination input from the voltage determination unit; and a power supply unit for supplying the source voltage, which is input through the power input unit, as the roller voltage to the heating resistor in response to the power control signal.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference numerals indicate the same or similar components, and wherein.

DETAILED DESCRIPTION OF THE INVENTION

Figure 1:
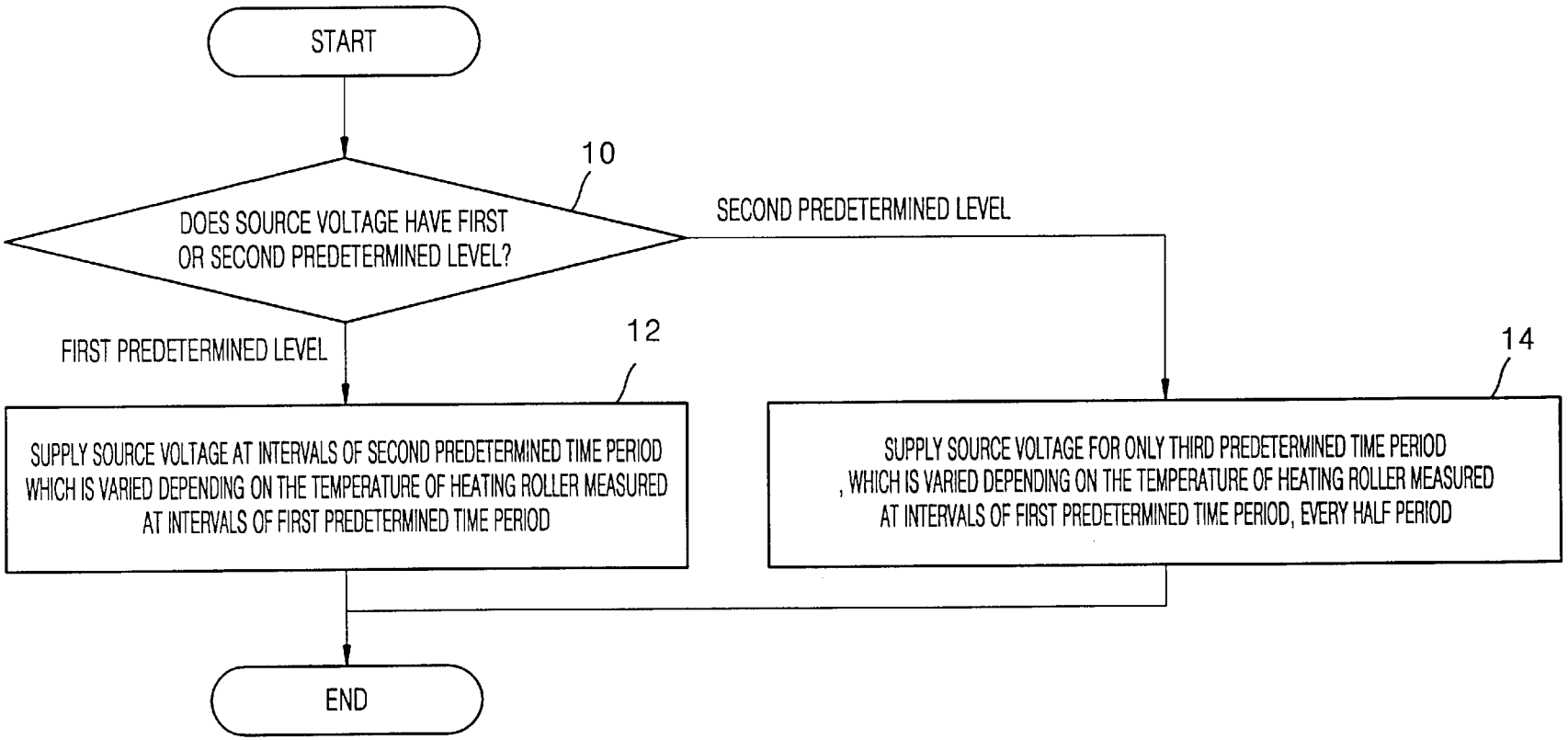
FIG. 1 is a flowchart of a power control method for an instant heat roller (IHR) according to the present invention.

A flowchart of a power control method for an instant heat roller (IHR) according to the present invention is shown in FIG. 1. The method involves steps 10 thru 14 of supplying a source voltage to a heating resistor in a predetermined manner according to the level of the source voltage.

The power control method of FIG. 1 is performed in a printing apparatus (not shown) having an IHR (not shown) for fixing toner images, and supplies a voltage (roller voltage) to a heating resistor (not shown) of the IHR in the manner described below, as a result of which the temperature of the IHR can reach a target fusing temperature within a shorter time period without need for a warm-up period, and the IHR is used for toner image fixing in a printing apparatus, such as a printer or copy machine.

Referring to FIG. 1, it is determined whether an external alternating current (AC) source voltage has a first predetermined level or second predetermined level in step 10. The first predetermined level is greater than the second predetermined level. For example, the first predetermined level may be in the range of 110–130 volts and the second predetermined level may be in the range of 180–230 volts.

FIGS. 2A thru 2G show the waveforms of pulses applied as roller voltages corresponding to 10%, 20%, 25%, 33%, 50%, 67%, and 100%, respectively, of the source voltage. In FIGS. 2A thru 2G, the dark half waves (referred to as "full-on pulses") represent the time period for which the source voltage is applied to the heating resistor. The non-dark half waves will be referred to as "full-off pulses".

If it is determined that the source voltage has the first predetermined level, the temperature of the heating resistor is periodically measured at intervals of a first predetermined time period, for example, 100 ms (step 12). Based on the measured temperature of the heating resistor, a second predetermined time period is varied depending on the measured temperature, as shown in FIGS. 2A thru 2G. The source voltage is applied as a roller voltage to the heating resistor at intervals of the varied second predetermined time period until the temperature of the heating resistor reaches a predetermined target fusing temperature (step 12). In step 12, the second predetermined time period is increased as the temperature of the resistor heater becomes close to the predetermined target fusing temperature. This is because a small source voltage is required for the heating resistor as the temperature of the heating resistor becomes close to the predetermined target fusing temperature. The term "target fusing temperature" refers to the temperature generated by the heating resistor when toner images are stably fixed. The temperature of the heating resistor may be directly measured from the heating resistor. Alternatively, the surface temperature of an IHR having the heating resistor is measured, and the temperature of the heating resistor may be derived from the measured surface temperature.

Figures 2A, 2B, 2C, 2D, 2E, 2F, 2G:
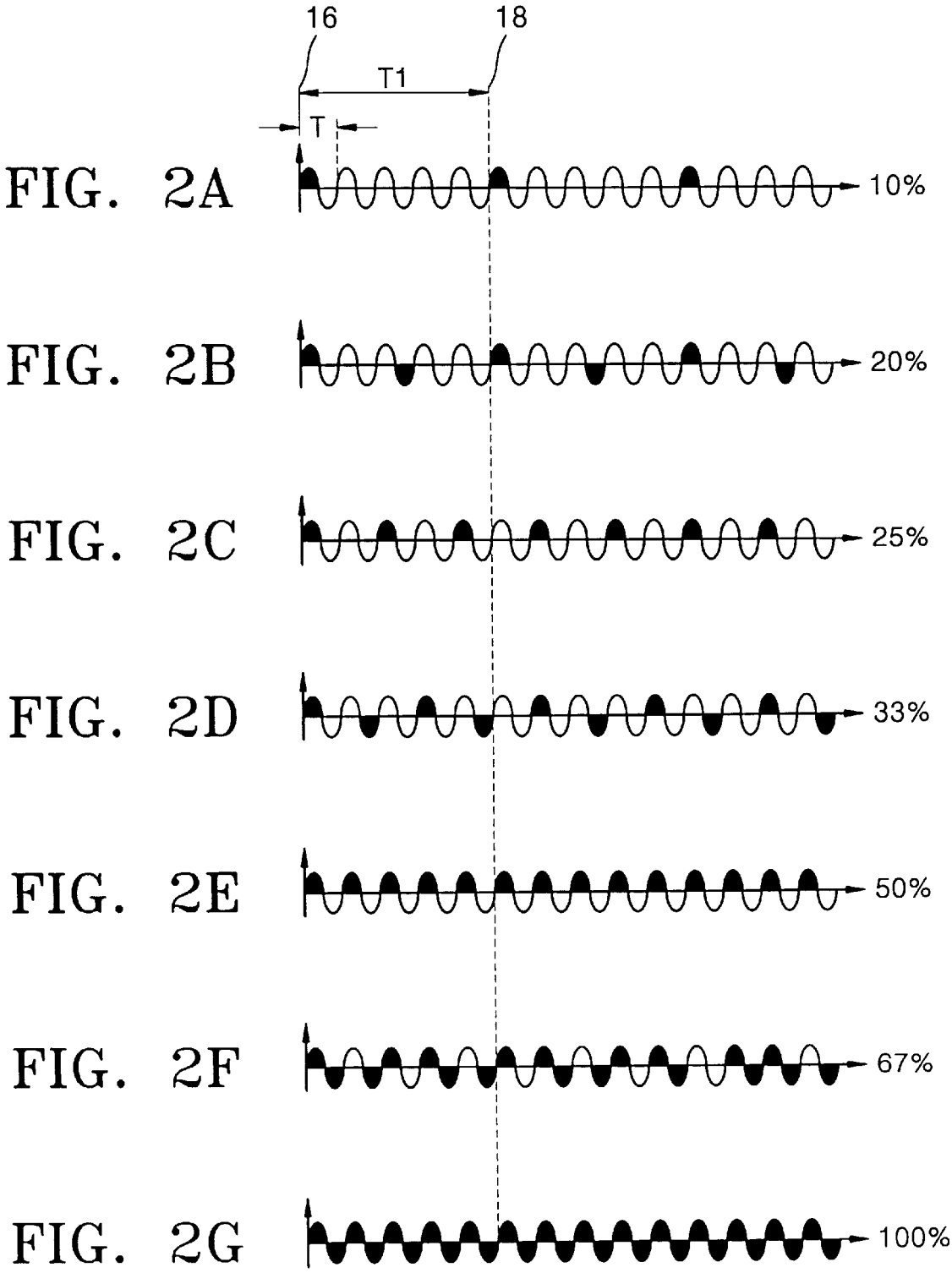
FIGS. 2A through 2G show the waveforms of externally input alternating current (AC) source voltages.

The first predetermined time period described above is equal to or greater than the second predetermined time period. The first predetermined time period (T1) can be set to be 5 times longer than a single period (T) of the input source voltage, as shown in FIGS. 2A thru 2G. If 10% of the input source voltage is supplied as the roller voltage, the second predetermined time period becomes 4.5T, as shown in FIG. 2A. In FIG. 2A, only one of the 10 half waves is a full-on pulse and nine of them are full-off pulses, so that only 10% of the source voltage is supplied as the roller voltage. As shown in FIGS. 2B, 2C, 2D, 2E, 2F and 2G, 20%, 25%, 33%, 50%, 70% and 100%, respectively, of the source voltage is supplied as the roller voltage, and the second predetermined time period can be varied to 2T, 1.5T, 1T, 0.5T, 0.5T, and 0T, respectively. In FIGS. 2D and 2F, the second predetermined time period is T and T/2, respectively. When a source voltage is supplied according to the waveform of FIG. 2D, 33% of the source voltage is supplied. If a source voltage is supplied according to the waveform of FIG. 2F, 67% of the source voltage is supplied. This is because the source voltage is applied every single period, not every half period, for the waveform of FIG. 2F.

Figure 3:
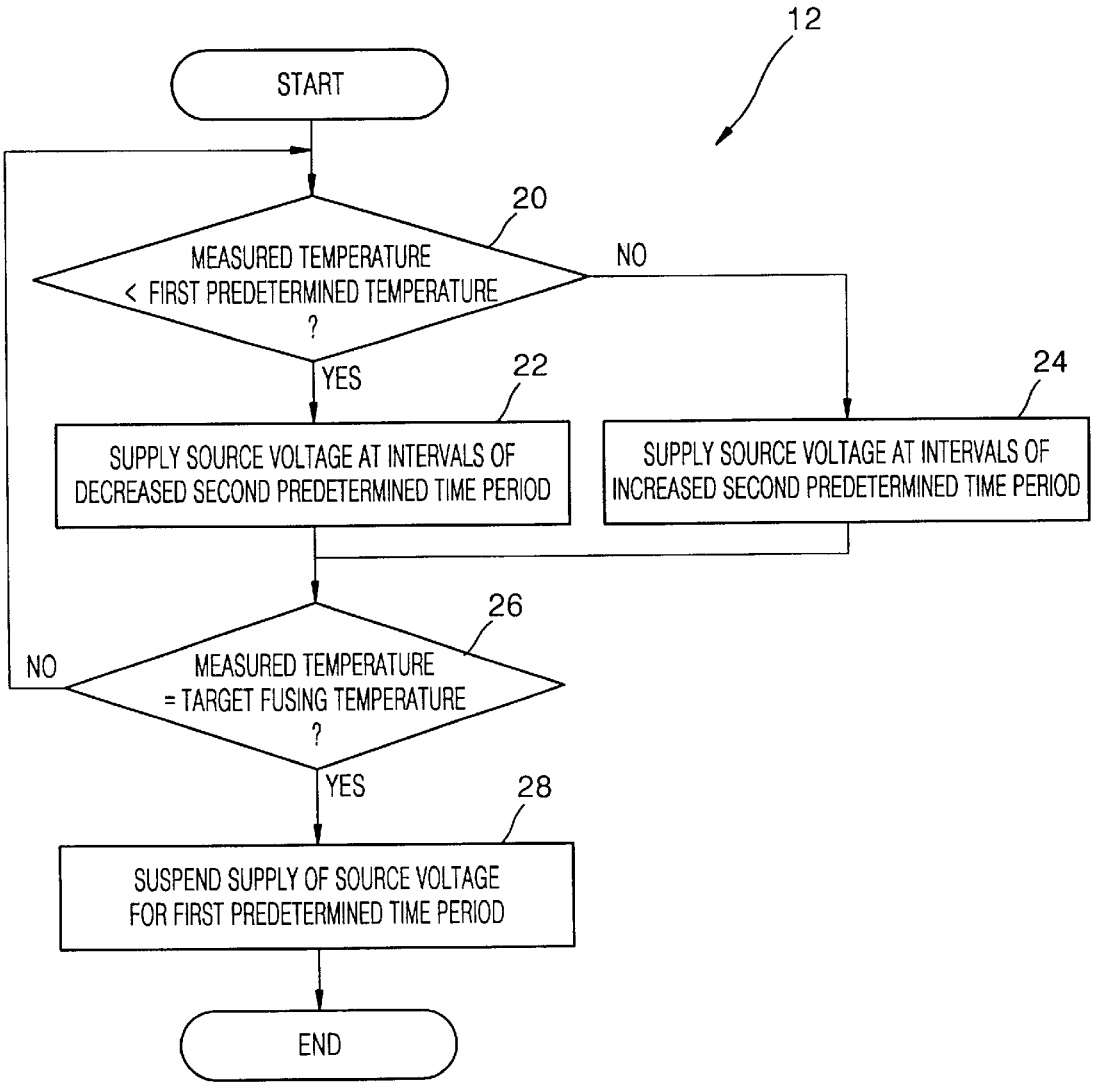
FIG. 3 is a flowchart of a preferred embodiment of step 12 of FIG. 1 according to the present invention.

A preferred embodiment of step 12 of FIG. 1 according to the present invention will be described with reference to FIG. 3, which is a flowchart of a preferred embodiment of step 12 of FIG. 1. FIG. 3 includes steps 20 thru 28 of applying the source voltage at intervals of the second predetermined time period, which is varied depending on the measured temperature of the heating resistor, and of suspending the application of the source voltage.

If it is determined that the input source voltage has the first predetermined level, it is determined whether the temperature of the heating resistor measured at any time 16 (FIG. 2A) is lower than a first predetermined temperature (step 20). The first predetermined temperature can be derived from the surface temperature of an instant heat roller, for example, 140° C. If it is determined that the measured temperature of the heating resistor is lower than the first predetermined temperature, the second predetermined time period is decreased, and the source voltage is applied to the heating resistor at intervals of the decreased second predetermined time period (step 22). For example, in step 22, the second predetermined time period may be decreased to "0" to apply 100% of the source voltage as the roller voltage, as shown in FIG. 2G.

Meanwhile, if it is determined that the temperature of the heating resistor is not lower than the first predetermined temperature, the second predetermined time period is increased and the source voltage is applied to the heating resistor at intervals of the increased second predetermined time period (step 24). For example, in step 24, the second predetermined time period may be increased to the single period "T" to apply 33% of the source voltage as the roller voltage, as shown in FIG. 2D.

After step 22 or 24, it is determined whether the temperature of the heating resistor measured at time 18 (FIG. 2A), when the first predetermined time passes from time 16, is equal to a predetermined target fusing temperature (step 26). If the temperature of the heating resistor is not equal to the predetermined target fusing temperature, the process goes back to step 20. Thus, steps 20 thru 24 are iterated according to the measured temperature of the heating resistor for a next first predetermined time period. However, if the temperature of the heating resistor is equal to the predetermined target fusing temperature, no source voltage is applied to the heating resistor for the next first predetermined time period (step 28). This is to prevent the temperature of the heating resistor from rising by oversupply of the source voltage to the heating resistor when the temperature of the heating resistor reaches the target fusing temperature.

Figure 4:
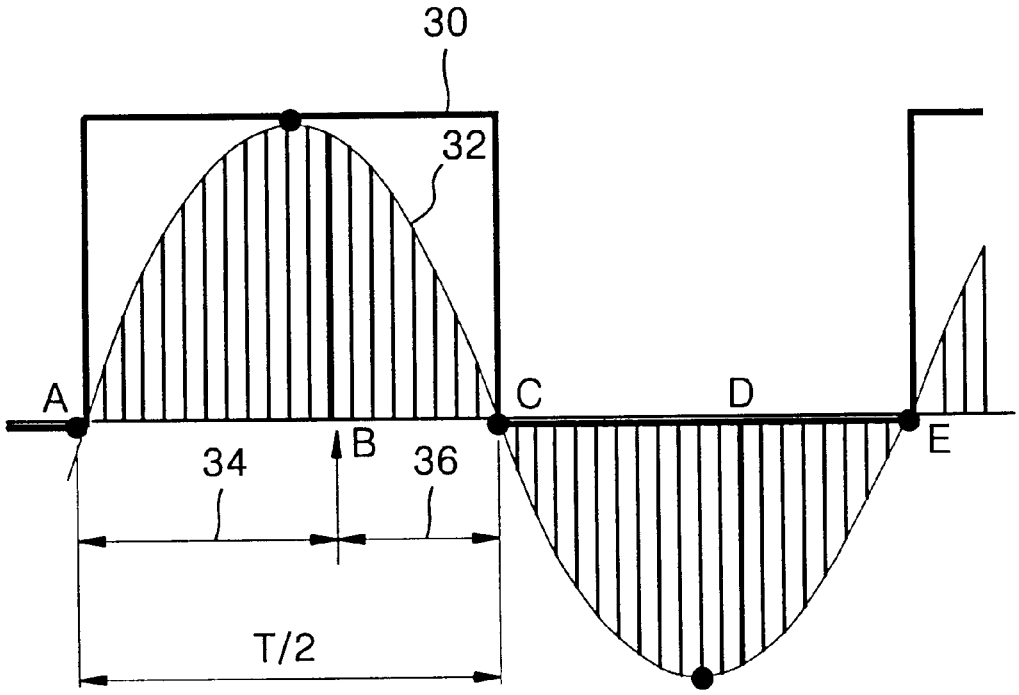
FIG. 4 shows the waveform of input source voltages for a single cycle.

FIG. 4 shows the waveform of the input source voltage for a single period, i.e., for an alternating current (AC) source voltage 32 and a square-wave source voltage 30.

Referring to FIGS. 1 and 4, when the input source voltage has the second predetermined level, a third predetermined time period denoted by reference numeral 36 is varied depending on the temperature of the heating resistor, which is periodically measured at the intervals of the first predetermined time period, until the temperature of the heating resistor reaches the predetermined target fusing temperature, and the source voltage is applied as the roller voltage to the heating resistor only for the varied third predetermined time period 36 during every half period (T/2) of the source voltage (step 14). The third predetermined time period, which is a non-constant value, varies depending on the temperature of the heating resistor, and is smaller than the half period (T/2) of the source voltage. For example, assuming that each half period (T/2) of the source voltage is divided into X sections and each of the X-sections is referred to as "phase angle", the phase angles existing in the leading part of the half period (T/2) collectively represent a duration of time for which no source voltage is applied to the heating resistor, and the phase angles existing in the lagging part of the half period (T/2) collectively represent the third predetermined time period for which the source voltage is applied to the heating resistor. For example, if X is equal to 20, as shown in FIG. 4, the leading 12 phase angles of the 20 phase angles, which are collectively denoted by reference numeral 34, correspond to the predetermined time period for which no source voltage is applied to the heating resistor. The lagging eight phase angles, which are collectively denoted by reference numeral 36, correspond to the third predetermined time period for which the source voltage is applied to the heating resistor. As described above, when the input source voltage has the second predetermined level, in the power control method according to the present invention, the process wherein no source voltage is supplied in interval A-B (or C-D) and the source voltage is supplied in interval B-C (or D-E) is repeatedly performed every half period (T/2).

The number of phase angles for the third predetermined time period varies depending on the measured temperature of the heating resistor. For example, the number of phase angles used for the third predetermined time period is greater in the initial state than in the normal state. In this case, as the temperature of the heating resistor approaches the predetermined target fusing temperature, the third predetermined time period becomes shorter. This is because the source voltage supplied to the heating resistor must be decreased as the temperature of the heating resistor approaches the predetermined target fusing temperature.

A preferred embodiment of step 14 of FIG. 1 according to the present invention will be described with reference to FIG. 5, which is a flowchart illustrating a preferred embodiment of step 14 of FIG. 1 according to the present invention. Step 14 involves steps 40 thru 48 of applying the source voltage for the third predetermined time period, which is varied depending on the temperature of the heating resistor, and steps 50 and 52 of suspending the supply of the source voltage depending on whether the temperature of the heating resistor reaches the target fusing temperature.

If it is determined that the input source voltage has the second predetermined level, it is determined whether the temperature of the heating resistor is lower than a second predetermined temperature (step 40). In this case, the second predetermined temperature is lower than the first predetermined temperature, and can be derived from the surface temperature of the IHR, i.e., 100° C. This is because there is a need to check the temperature of the heating resistor at shorter time intervals when the input source voltage has the second predetermined level greater than the first predetermined level due to the rapid rate of temperature increase of the heating resistor.

If it is determined that the temperature of the heating resistor is lower than the second predetermined temperature, the third predetermined time period is increased, the source voltage is supplied to the heating resistor only for the increased third predetermined time period of each half period (T/2), and the process goes back to step 40 (step 42). In this case, the reason for increasing the third predetermined time period is that there is a need to supply the source voltage to the heating resistor for a sufficient time period because the temperature of the heating resistor is low. For example, the third predetermined time period may be increased to T/4. That is, the number of phase angles of the third predetermined time period 36, which is eight in FIG. 4, can be increased to ten.

Meanwhile, if the temperature of the heating resistor is equal to or higher than the second predetermined temperature, it is determined whether the temperature of the heating resistor is lower than a third predetermined temperature (step 44). The third predetermined temperature may be set to be approximately the predetermined target fusing temperature. The third predetermined temperature may be derived from the surface temperature of the IHR, for example, 150° C. The third predetermined temperature is higher than the second predetermined temperature.

If it is determined that the temperature of the heating resistor is lower than the third predetermined temperature, i.e, if the temperature of the heating resistor is equal to or greater than the second predetermined temperature and is lower than the third predetermined temperature, the third predetermined time period is decreased, the source voltage is supplied to the heating resistor only for the decreased third predetermined time period, and the process goes back to step 44 (step 46). The reason for decreasing the third predetermined time period is to slowly increase the temperature of the heating resistor because the temperature of the heating resistor is beyond the second predetermined temperature. Decreasing the third predetermined time period is the same as decreasing the number of phase angles for the third predetermined time period. For example, in step 46, the number of phase angles of the third predetermined time period may be decreased to seven. This is the same as decreasing the length of the third predetermined time period to 7T/2X, where X is the number of the phase angles existing in each half pulse period.

However, if the temperature of the heating resistor is not lower than the third predetermined temperature, the third predetermined time period is further decreased, and the source voltage is supplied to the heating resistor only for the further decreased third predetermined time period (step 48). For example, in step 48, the number of phase angles for the third predetermined time period may be decreased to three. This is the same as decreasing the length of the third predetermined time period to 3T/2X. The third predetermined time period decreased in step 48 is shorter than the third predetermined time period decreased in step 46.

After step 48, it is determined whether the temperature of the heating resistor is equal to the predetermined target fusing temperature (step 50). If it is determined that the temperature of the heating resistor is not equal to the target fusing temperature, the process goes back to step 48 to further increase the temperature of the heating resistor.

Meanwhile, if it is determined that the temperature of the heating resistor is equal to the predetermined target fusing temperature, the supply of the source voltage to the heating resistor is suspended (step 52). This is to prevent damage to the printing apparatus, which is performing the power control method according to the present invention, by excessive power supply. To keep the temperature of the heating resistor at the target fusing temperature, the number of the phase angles in interval B-C (or D-E) of each half period (T/2) for which the source voltage is applied is maintained, for example, at three.

In other words, in the power control method according to the present invention, when an input source voltage has a first predetermined logic level and the temperature of the heating resistor is lower than the target fusing temperature, the temperature of the heating resistor is increased for repeated full-on pulses. The lower the temperature of the heating resistor relative to the target fusing temperature, the greater the number of full-on pulses for the first predetermined time period, i.e., the second predetermined time period is decreased. Thus, the amount of transferred heat increases, so that the temperature of the heating resistor rapidly increases. Meanwhile, as the temperature of the heating resistor approaches the target fusing temperature, the number of full-on pulses for the first predetermined time period is decreased, i.e. the second predetermined time period is increased.

In the power control method according to the present invention, when an input source voltage has a second predetermined logic level and the temperature of the heating resistor is lower than the target fusing temperature, the source voltage is not supplied in the phase angles existing in the leading part of each half period, for example, in intervals A-B and C-D of FIG. 4, and the source voltage is applied in the phase angles existing in the lagging part of each half period, for example, in intervals B-C and D-E of FIG. 4. Thus, by repeatedly supplying the source voltage, the temperature of the heating resistor of the IHR is increased to the target fusing temperature. That is, the lower the temperature of the heating resistor relative to the target fusing temperature, the greater the number of phase angles of the lagging part of each half period, i.e., the third predetermined time period is increased. Meanwhile, as the temperature of the heating resistor approaches the target fusing temperature, the number of phase angles of the lagging part of each half pulse period is decreased, i.e., the third predetermined time period is reduced. When the temperature of the heating resistor reaches the target fusing temperature, the supply of the source voltage to the heating resistor is suspended for a first predetermined time period.

Figure 6:
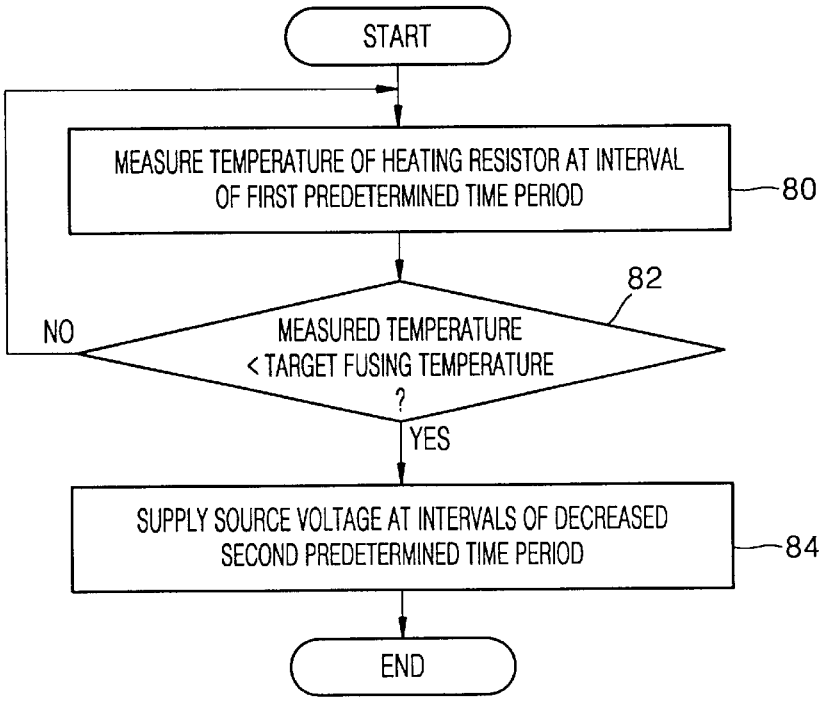
FIG. 6 is a flowchart of a power control method according to the present invention performed in a normal state where the input source voltage has a first predetermined level.

The above-described power control method according to the present invention, illustrated in FIG. 2 or 3, is performed from the initialization state to the normal state. The power control method according to the present invention supplies a source voltage to the heating resistor in the normal state, and will be described as follows FIG. 6 is a flowchart illustrating a power control method according to the present invention as performed in a normal state where the input source voltage has the predetermined first level. The method of FIG. 6 involves steps 80 thru 84 of supplying the source voltage in accordance with the measured temperature of the heating resistor.

First, in the normal state where the source voltage having the first predetermined level is given, that is, after step 12 of FIG. 1, the temperature of the heating resistor is measured at an interval of the first predetermined time period (step 80). Then, it is determined whether the temperature of the heating resistor measured in step 80 is lower than the predetermined target fusing temperature (step 82).

If it is determined that the temperature of the heating resistor measured in step 80 is not lower than the predetermined target fusing temperature, step 80 is iterated. Meanwhile, if it is determined that the temperature of the heating resistor measured in step 80 is lower than the predetermined target fusing temperature, the second predetermined time period is decreased and the source voltage is applied to the heating resistor at intervals of the decreased second predetermined time period (step 84). For example, because the measured temperature of the heating resistor is lower than the target fusing temperature, i.e., the temperature of the heating resistor drops below the target fusing temperature in the normal state, the second predetermined time period is decreased to supply the source voltage again to the heating resistor, i.e., for power supplement. Thus, the occurrence of ripple can be minimized. In step 84, the second predetermined time period is decreased to, for example, one period (1T), as shown in FIG. 2D, such that only 33% of the source voltage is supplied to the heating resistor.

Figure 7:
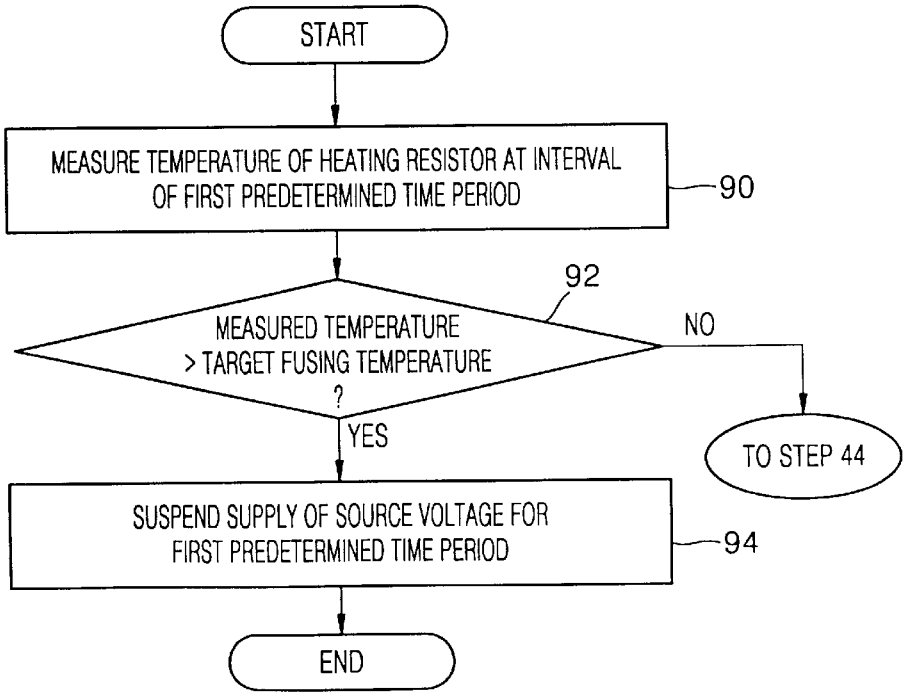
FIG. 7 is a flowchart of a power control method according to the present invention performed in a normal state where the input source voltage has a second predetermined level.

FIG. 7 is a flowchart illustrating a power control method according to the present invention, as performed in a normal state where the input source voltage has the second predetermined level. The method of FIG. 7 involves steps 90 thru 94 and steps 44 thru 52 of supplying the source voltage or suspending the supply of the source voltage in accordance with the measured temperature of the heating resistor.

In the normal state when the source voltage having the second predetermined level is given, that is, after step 14 of FIG. 1, the temperature of the heating resistor is measured at an interval of the first predetermined time period (step 90). Then, it is determined whether the temperature of the heating resistor measured in step 90 is higher than the predetermined target fusing temperature (step 92). If it is determined that the temperature of the heating resistor measured in step 90 is lower than or equal to the predetermined target fusing temperature, the process goes to step 44 of FIG. 5 to reduce the rate of temperature increase of the heating resistor and steps 44 thru 52 are performed as described above. The rate of temperature increase of the heating resistor can be reduced by reducing the third predetermined time period depending on the measured temperature of the heating resistor.

Meanwhile, if it is determined that the temperature of the heating resistor measured in step 90 is higher than the predetermined target fusing temperature, the supply of the source voltage to the heating resistor is suspended for the first predetermined time period (step 94).

The predetermined target fusing temperature referred to in the description of FIGS. 1, 3, 5, 6, and 7 is set to a fourth predetermined temperature before the lapse of a fourth predetermined time period from the initialization of the IHR, and to a fifth predetermined temperature after the lapse of the fourth predetermined time period. The fourth predetermined time period is a duration of time which is required to approximately stabilize a printing apparatus having the IHR to which power is supplied by the power control method according to the present invention. Thus, because the heat transferred to the heating resistor is sufficient when the fourth predetermined time period passes, there is a need to reduce the target fusing temperature to save the power consumed by the printing apparatus. For example, at a normal temperature of about 35° C. and a normal humidity of about 55%, the fourth predetermined time period may be set to 5 minutes. In this case, the target fusing temperature is set to the fourth predetermined temperature, for example, 175° C., before the lapse of 5 minutes from the initialization of the IHR, and to the fifth predetermined temperature, for example, 165° C., which is 10° C. lower than the fourth predetermined temperature, when 5 minutes elapses.

Assuming that the second predetermined temperature is derived from the surface temperature of the IHR of 100° C., and that the third predetermined temperature is derived from the surface temperature of the IHR of 150° C., the temperature variations of the IHR with respect to time, when the source voltage is supplied to the heating resistor of the IHR according to the power control method of the present invention, will now be described.

Figure 8:
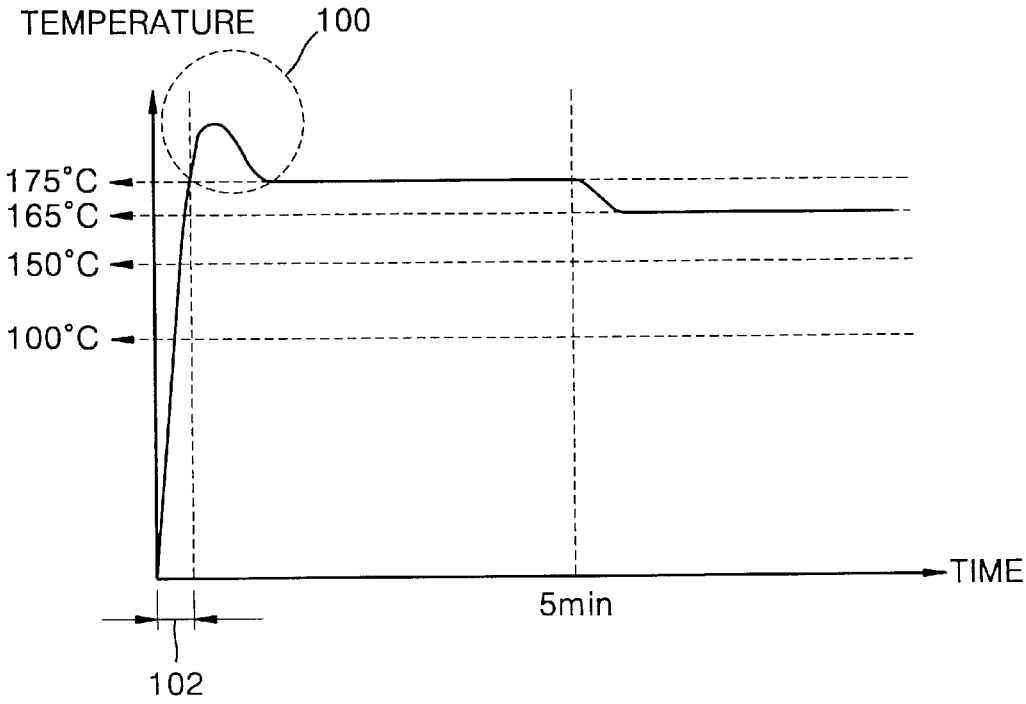
FIG. 8 is a graph showing the temperature variations of the IHR with respect to time.

FIG. 8 is a graph illustrating the temperature variations of the IHR with respect to time. In FIG. 8, the horizontal axis represents time and the vertical axis represents temperature. The power control method of FIG. 3 or 5 is performed in an initialization state 102 shown in FIG. 8, and the power control method of FIG. 6 or 7 is performed in the normal state following the initialization state 102. As shown in FIG. 8, unlike a conventional roller employing a halogen lamp, the IHR reaches the target fusing temperature of 175° C. within about 7–8 seconds. Because the rate of temperature increase of the IHR is very rapid, the power control method according to the present invention controls the number of full-on pulses when the source voltage level is low, and controls the number of phase angles of the third predetermined time period when the source voltage level is high, so that an "overshoot" phenomenon, which is denoted by reference numeral 100 in FIG. 8, can be minimized.

The structure and operation of a power control apparatus for the IHR according to the present invention, which performs the above-described power control method, will be described with reference to FIG. 9, which is a block diagram of such a power control apparatus according to the present invention. The power control apparatus includes: a power input unit 110; a voltage determination unit 112; a frequency determination unit 114; a controller 116; a temperature measuring unit 118; first, second, third and fourth comparison units 120, 122, 124 and 126, respectively; and a power supply unit 128.

The power input unit 110 receives an external source voltage input through an input port IN and provides it to the voltage determination unit 112, the frequency determination unit 114, and the power supply unit 128. In order to perform step 10 of FIG. 1, the voltage determination unit 112 determines whether the source voltage input from the power input unit 110 has a first predetermined level or a second predetermined level, and outputs the result of the determination to the controller 116. The structure and operation of a preferred embodiment of the voltage determination unit 112 according to the present invention will be described with reference to FIG. 10, which is a circuit diagram of a preferred embodiment of the voltage determination unit 112 of FIG. 9 according to the present invention.

The voltage determination unit 112 includes: a level dropping portion 150, a rectifying portion 152, a voltage dividing portion 154, a reference voltage generating portion 156, and a comparison portion 158. The level dropping portion 150 of FIG. 10 drops the level of the source voltage Vs input through the power input unit 110, and outputs the resultant dropped voltage to the rectifying portion 152. To this end, the level dropping portion 150 may be implemented by a step-down transformer. The rectifying portion 152 rectifies the dropped voltage input from the level dropping portion 150, and outputs the rectified result to the voltage dividing portion 154. The rectifying portion 152 may be implemented with a diode D1 for half-wave rectifying the dropped voltage.

The voltage dividing portion 154 divides the level of the rectified result from the rectifying portion 152, and outputs a comparison signal having a divided level to the comparison portion 158. To this end, the voltage dividing portion 154 may be implemented by a resistor R1 having one end connected to the cathode of the diode D1, a capacitor C1 connected in parallel to the resistor R1, series resistors R2 and R3 connected in parallel to the resistor R1, and a resistor R4 connected between the connection point of resistors R2 and R3 and the comparison portion 158. In this configuration, the voltage dividing portion 154 divides the rectified result by means of the resistors R2 and R3, and outputs the divided voltage as the comparison signal provided to the comparison portion 158.

The reference voltage generating portion 156 generates and outputs a predetermined reference signal to the comparison portion 158. To this end, the reference voltage generating portion 156 may be implemented by a resistor R5 having one end connected to the comparison portion 158, a capacitor C2 connected in parallel to the resistor R5, and a resistor R6 connected between the comparison portion 158 and a power supply VCC. In this configuration, the reference voltage generating portion 156 can generate the reference signal of, for example, 150 Va, where Va indicates the amplitude of the source voltage.

The comparison portion 158 compares the reference signal generated by the reference voltage generating portion 156 and the comparison signal, and outputs the result of the comparison, as a determination result, through an output port OUT2. Thus, the controller 116 can recognize whether the level of the external source voltage is, for example, 100 or 200 volts, from the determination result input from the voltage determination unit 112. To this end, the comparison portion 158 may be implemented by a comparator 160 having a non-inverting input port (+) for receiving the comparison signal, an inverting input port (−) for receiving the reference signal, and an output port for outputting the determination result, with a resistor R7 being connected between the output port of the comparator 160 and a supply voltage VCC. The comparison signal input to the non-inverting input port (+) of the comparator 160 varies depending on the level of the AC source voltage. Thus, assuming that the reference signal input through the inverting input port (−) of the comparator 160 has a level of 150 Va, as described above, the comparator 160 outputs a logic "low" as the result of a determination that the level of the comparison signal is lower than 150 Va, and outputs a logic "high" as the result of a determination that the level of the comparison signal is higher than 150 Va. The controller 116 recognizes the level of the source voltage as a first predetermined logic level if a logic "low" determination result is input from the voltage determination unit 112, and as a second predetermined logic level if a logic "high" determination result is input.

Figure 9:
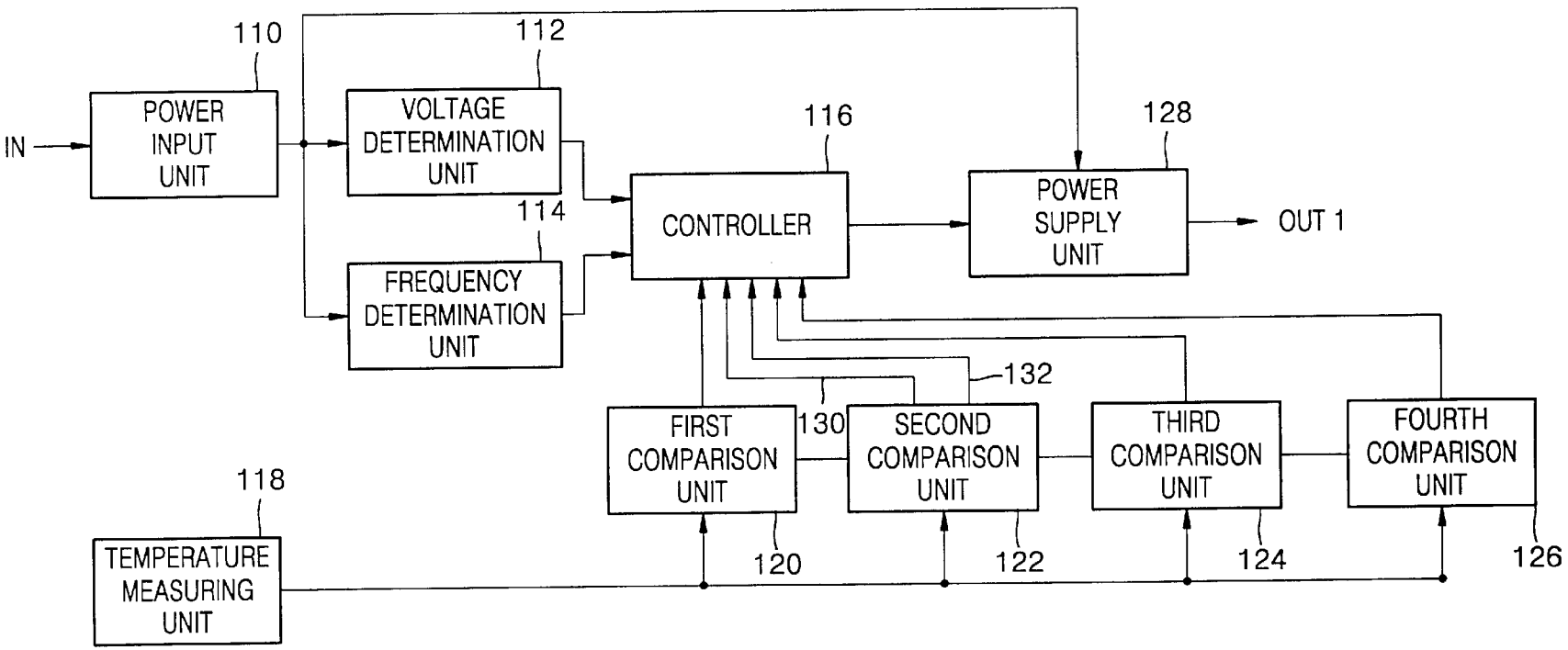
FIG. 9 is a block diagram of a power control apparatus according to the present invention by means of which the power control method described above is performed.
Figure 10:
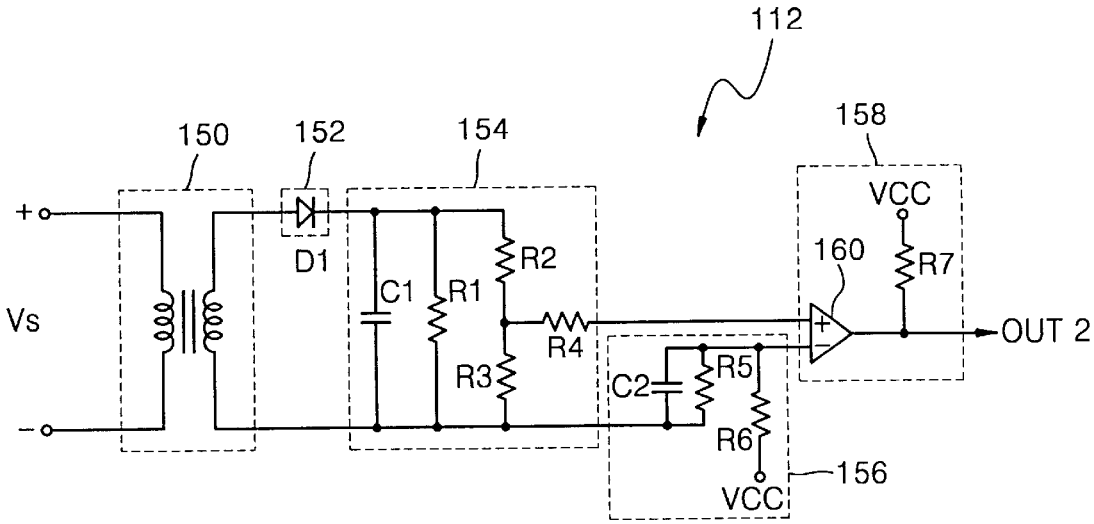
FIG. 10 is a circuit diagram of a preferred embodiment of the voltage determination unit of FIG. 9.

Meanwhile, the temperature measuring unit 118 of FIG. 9 measures the temperature of the heating resistor, and outputs the measured temperature to each of the first, second, third, and fourth comparison units 120, 122, 124, and 126, respectively. For example, to perform step 80 of FIG. 6 or step 90 of FIG. 7, the temperature measuring portion 118 measures the surface temperature of the IHR, and can derive the temperature of the heating resistor from the measured surface temperature of the IHR.

To perform step 20 of FIG. 3, the first comparison unit 120 compares the temperature measured by the temperature measuring unit 118 with the first predetermined temperature, and outputs the result of the comparison to the controller 116. In order to perform step 26 of FIG. 3 or step 50 of FIG. 5, the second comparison unit 122 compares the temperature measured by the temperature measuring unit 118 with a predetermined target fusing temperature to determine whether the two temperatures are the same, and outputs the comparison result 130 (FIG. 9) to the controller 116. Also, in order to perform step 82 of FIG. 6 or step 92 of FIG. 7, the second comparison unit 122 also compares the measured temperature with the target fusing temperature to determine whether or not the measured temperature is higher or lower than the target fusing temperature, and outputs the comparison result 132 to the controller 116. To perform step 40 of FIG. 5, the third comparison unit 124 compares the temperature measured by the temperature measuring unit 118 with the second predetermined temperature, and outputs the comparison result to the controller 116. To perform step 44 of FIG. 5, the fourth comparison unit 126 compares the temperature measured by the temperature measuring unit 118 with the third predetermined temperature, and outputs the comparison result to the controller 116.

The power supply unit 128 outputs the source voltage input through the power input unit 110 as the roller voltage to the heating resistor through the output port OUT1 in response to a power control signal generated by the controller 116.

The controller 116 outputs the power control signal, which is generated according to the comparison results from the first, second, third, and fourth comparison units 120, 122, 124, and 126, and the determination result from the voltage determination unit 112, to the power supply unit 128. For example, to perform steps 22 and 24 of FIG. 3, the controller 116 decreases or increases the second predetermined time period in response to the comparison result from the first comparison unit 120, and generates the power control signal which controls the power supply unit 128 such that the source voltage is output through the power supply unit 128 at intervals of the decreased or increased second predetermined time period. Also, the controller 116 proceeds to step 20 of FIG. 3 or performs step 28 in response to the comparison result 130 from the second comparison unit 122. That is, to proceed to step 20, the controller 116 receives again the comparison result from the first comparison unit 120 when it is determined from the comparison result 130 from the second comparison unit 122, that the measured temperature is not the same as the target fusing temperature. To perform step 28, when it is determined from the comparison result 130 from the second comparison unit 122, that the measured temperature is the same as the target fusing temperature, the controller 116 generates the power control signal which controls the power supply unit 128 such that no source voltage is supplied to the heating resistor for the first predetermined time period.

Figure 5:
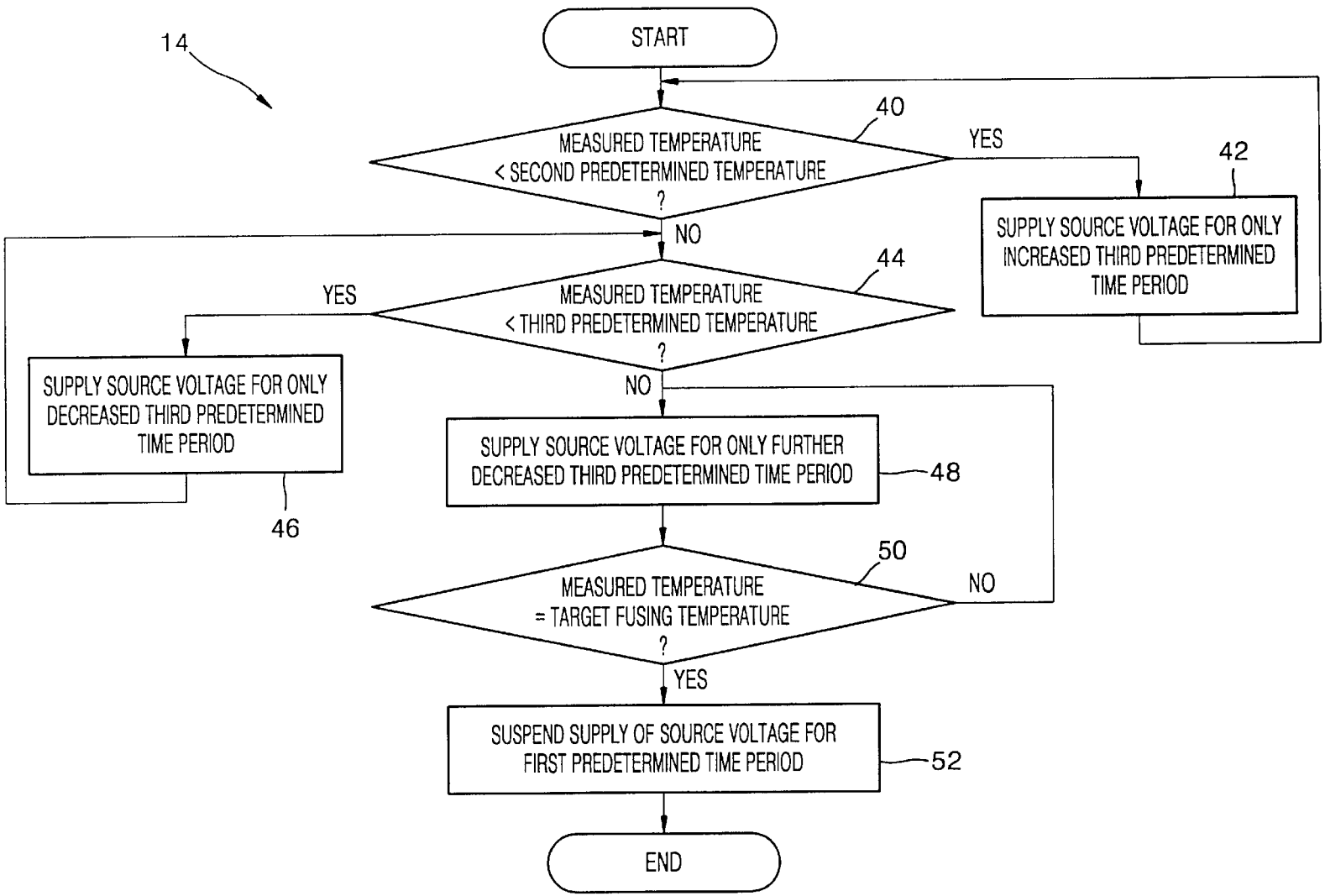
FIG. 5 is a flowchart of a preferred embodiment of step 14 of FIG. 1 according to the present invention.

To perform step 42 of FIG. 5, if it is determined that the measured temperature is lower than the second predetermined temperature from the comparison result from the third comparison unit 124, the controller 116 increases the third predetermined time period and generates a power control signal which controls the power supply unit 128 such that the source voltage is supplied to the heating resistor through the power supply unit 128 for the increased third predetermined time period. To perform step 46 or 48, the controller 116 decreases the third predetermined time period in response to the comparison result from the fourth comparison unit 126, and generates a power control signal which controls the power supply unit 128 such that the source voltage is supplied to the heating resistor through the power supply unit 128 for the decreased third predetermined time period. To perform step 52, if it is determined that the measured temperature is the same as the target fusing temperature from the comparison result 130 from the second comparison unit 122, the controller 116 generates a power control signal which controls the power supply unit 128 such that no source voltage is supplied to the heating resistor through the power supply unit 128.

In addition, if it is determined that the measured temperature is higher or lower than the target fusing temperature from the comparison result 132 from the second comparison unit 122, the controller 116 performs step 84 of FIG. 6 or step 94 of FIG. 7. That is, if it is recognized that the source voltage has the first predetermined level from the determination result from the voltage determination unit 112, to perform step 84, the controller 116 decreases the second predetermined time period in response to the comparison result 132 from the second comparison unit 122 and generates a power control signal which controls the power supply unit 128 such that the source voltage is supplied to the heating resistor through the power supply unit 128 at intervals of the decreased second predetermined time period. On the other hand, if it is recognized that the source voltage has the second predetermined level from the determination result from the voltage determination unit 112, to perform step 94, the controller 116 generates, in response to the comparison result 132 from the second comparison unit 122, a power control signal which controls the power supply unit 128 such that the supply of the source voltage to the heating resistor through the power supply unit 128 is suspended for the first predetermined time period.

To calculate the first, second, and third predetermined time periods needed for performing the above-mentioned operations, the controller 116 utilizes the frequency (1/T) determined by and output from the frequency determination unit 114. In this case, the frequency determination unit 114 determines the frequency (1/T) of the source voltage input through the power input unit 110, and outputs the determined frequency (1/T) to the controller 116. The power control apparatus, according to the present invention, can calculate the first, second, and third predetermined time periods depending on the frequency of the source voltage. For example, the frequency of the source voltage may be 50 or 60 Hz.

Figure 11:
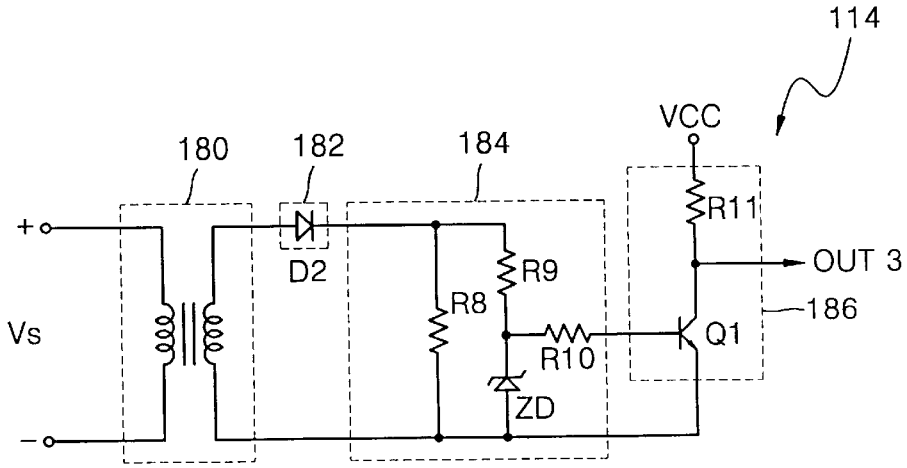
FIG. 11 is a circuit diagram of a preferred embodiment of the frequency determination unit of FIG. 9.

The structure and operation of a preferred embodiment of the frequency determination unit 114 of FIG. 9 according to the present invention will be described with reference to FIG. 11, which is a circuit diagram of such a preferred embodiment of the frequency determination unit 114 of FIG. 9. The frequency determination unit 114 includes a level dropping portion 180, a rectifying portion 182, a constant-voltage generating portion 184, and a switching portion 186. The level dropping portion 180 and the rectifying portion 182 of FIG. 11 are the same as the level dropping portion 150 and the rectifying portion 152 of FIG. 10, respectively, and thus detailed descriptions thereof are not provided here. Like the diode D1 of FIG. 10, the diode D2 of the rectifying portion 182 half-wave rectifies the dropped voltage.

The constant-voltage generating portion 184 generates a predetermined constant voltage from the result of the rectification by the rectifying portion 182, and outputs the constant voltage to the switching portion 186. To this end, the constant-voltage generator 184 may be implemented by resistors R8 and R9 having one end connected to the cathode of the diode D2, a zener diode ZD having an anode connected to the other end of the resistor R9, and a resistor R10 connected between the anode of the zener diode ZD and the switching portion 186. The zener diode ZD acts to maintain the constant voltage at, for example, 5.1 volts.

The switching portion 186 performs on/off switching in response to the constant voltage output from the constant-voltage generating portion 184, and outputs the result of the switching to the controller 116 through an output port OUT3. That is, a transistor Q1 is switched when AC source voltage Vs crosses zero, so that a square wave having the same phase as the AC source voltage is output to the controller 116 through the output port OUT3. In this case, the controller 116 can recognize whether the source voltage has a frequency of, for example, 50 or 60 Hz, from the square wave output resulting from the switching in portion 186, as provided through the output port OUT3. To this end, the switching portion 186 may be implemented by a transistor Q1, whose base is connected to the constant-voltage generating portion 184, and a resistor R11 connected between the collector of the transistor Q1 and the supply power VCC.

Meanwhile, for digital operation, the power control apparatus of FIG. 9 according to the present invention may include an analog-to-digital converter (not shown) in the temperature measuring unit 118 for converting the temperature measured in an analog form into a digital form. In this case, each of the first, second, third and fourth comparators 120, 122, 124, and 126, respectively, compares the digital temperature with corresponding values. Thus, the controller 116 can digitally control the above-described operations by receiving the digital results of the comparisons output from the first, second, third and fourth comparison units 120, 122, 124, and 126, respectively.

The power control method according to the present invention controls the roller voltage supply using the full-on and full-off pulses when the source voltage has a first predetermined level, and using the number of the phase angles into which the half period (T/2) of the source voltage is divided when the source voltage has a second predetermined level. That is, the supply of the roller voltage is more precisely controlled for the source voltage having the second predetermined level than for the source voltage having the first predetermined level.

As described above, the power control method and apparatus for an IHR according to the present invention can stably supply source voltage to the heating resistor of the IHR even when the level or frequency of the external source voltage changes. In addition, the occurrence of the overshoot phenomenon due to a rapid rate of temperature increase of the IHR is minimized, and the temperature of the IHR can stably reach a target fusing temperature, even during the start of printing operation. The power consumption during the printing operation is reduced, minimizing the occurrence of flicker.

While this invention has been particularly shown and described with reference to preferred embodiments thereof, it will be understood by those skilled in the art that various changes in form and detail may be made therein without departing from the spirit and scope of the invention as defined by the appended claims.

What is claimed is:

1. A power control method for controlling a roller voltage applied to a heating resistor of an instant heating roller (IHR), comprising the steps of:

(a) determining whether an external source voltage has a first predetermined level or a second predetermined level greater than the first predetermined level;

(b) when it is determined that the source voltage has the first predetermined level, supplying the source voltage as the roller voltage to the heating resistor at intervals of a second predetermined time period until a temperature of the heating resistor, measured at intervals of a first predetermined time period, reaches a predetermined target fusing temperature; and (c) when it is determined that the source voltage has the second predetermined level, supplying the source voltage as the roller voltage to the heating resistor during a third predetermined time period for every half period of the source voltage until the temperature of the heating resistor, measured at intervals of the first predetermined time period, reaches the predetermined target fusing temperature;

wherein, as the temperature of the heating resistor approaches the predetermined target fusing temperature, the second predetermined time period in step (b) is increased and the third predetermined time period in step (c) is decreased, and the first predetermined time period is not less than the second predetermined time period.

2. The power control method of claim 1, wherein step (b) comprises:

(b1) when it is determined that the source voltage has the first predetermined level, determining whether the temperature of the heating resistor is lower than a first predetermined temperature;

(b2) when it is determined that the temperature of the heating resistor is lower than the first predetermined temperature, decreasing the second predetermined time period and supplying the source voltage to the heating resistor at intervals of the decreased second predetermined time period;

(b3) when it is determined that the temperature of the heating resistor is not lower than the first predetermined temperature, increasing the second predetermined time period and supplying the source voltage to the heating resistor at intervals of the increased second predetermined time period;

(b4) after one of steps (b2) and (b3), determining whether the temperature of the heating resistor is equal to the predetermined target fusing temperature, and proceeding to and executing step (b1) when it is determined that the temperature of the heating resistor is not equal to the predetermined target fusing temperature;

(b5) when it is determined that the temperature of the heating resistor is equal to the predetermined target fusing temperature, suspending the supply of the source voltage to the heating resistor for the first predetermined time period.

3. (Currently Once Amended) The power control method of claim 2, wherein the temperature of the heating resistor is obtained by measuring the surface temperature of the instant heating roller.

4. The power control method of claim 3, wherein the first predetermined time period is 5T, the increased second predetermined time period is T, and the decreased second predetermined time period is 0, where T is a period of the source voltage.

5. The power control method of claim 3, wherein the first predetermined time period is 5T, the increased third predetermined time period is T/4, the third predetermined time period for every half period of the source voltage is 7T/2X , and the decreased third predetermined time period is 3T/2X, where T is a period of the source voltage and X is a number of sections into which a half period (T/2) is divided.

6. (Currently Once Amended) The power control method of claim 5, wherein the predetermined target fusing temperature is set to a fourth predetermined temperature before lapse of a fourth predetermined time period from an initialization point of the instant heating roller, and to a fifth predetermined temperature after the lapse of the fourth predetermined time period, and wherein the fifth predetermined temperature is lower than the fourth predetermined temperature.

7. The power control method of claim 2, further comprising the steps of:

(d) measuring a temperature of the heating resistor at an interval of the first predetermined time period after step (b5);

(e) determining whether the temperature measured in step (d) is lower than the predetermined target fusing temperature, and proceeding to and executing step (d) when it is determined that the measured temperature is not lower than the predetermined target fusing temperature; and (f) when it is determined that the temperature measured in step (d) is lower than the predetermined target fusing temperature, decreasing the second predetermined time period and supplying the source voltage to the heating resistor at intervals of the decreased second predetermined time period.

8. The power control method of claim 7, wherein the predetermined target fusing temperature is set to a second predetermined temperature before lapse of a fourth predetermined time period from an initialization point of the instant heating roller, and to a third predetermined temperature after the lapse of the fourth predetermined time period, and wherein the third predetermined temperature is lower than the second predetermined temperature.

9. The power control method of claim 1, wherein step (b) comprises determining whether the temperature of the heating resistor is lower than a first predetermined temperature when it is determined that the source voltage has the first predetermined level; and wherein step (c) comprises:

(c1) when it is determined that the source voltage has the second predetermined level, determining whether the temperature of the heating resistor is lower than a second predetermined temperature;

(c2) when it is determined that the temperature of the heating resistor is lower than the second predetermined temperature, increasing the third predetermined time period, supplying the source voltage to the heating resistor for only the increased third predetermined time period, and proceeding to and executing step (c1);

(c3) determining whether the temperature of the heating resistor is lower than a third predetermined temperature when it is determined that the temperature of the heating resistor is not lower than the second predetermined temperature;

(c4) when it is determined that the temperature of the heating resistor is lower than the third predetermined temperature, decreasing the third predetermined time period, supplying the source voltage to the heating resistor for only the decreased third predetermined time period, and proceeding to and executing step (c3);

(c5) when it is determined that the temperature of the heating resistor is not lower than the third predetermined temperature, decreasing the third predetermined time period and supplying the source voltage to the heating resistor for the decreased third predetermined time period;

(c6) after step (c5), determining whether the temperature of the heating resistor is equal to the predetermined target fusing temperature, and proceeding to and executing step (c5) when it is determined that the temperature of the heating resistor is not equal to the predetermined target fusing temperature; and (c7) when it is determined that the temperature of the heating resistor is equal to the predetermined target fusing temperature, suspending the supply of the source voltage to the heating resistor;

wherein the second predetermined temperature is lower than the first predetermined temperature, and the amount of decrease of the third predetermined time period in step (c4) is smaller than the amount of decrease of the third predetermined time period in step (c5).

10. The power control method of claim 9, wherein the temperature of the heating resistor is obtained by measuring the surface temperature of the instant heating roller.

11. The power control method of claim 9, further comprising the steps of:

(g) measuring a temperature of the heating resistor at an interval of the first predetermined time period after step (c7);

(h) determining whether the temperature measured in step (g) exceeds the predetermined target fusing temperature, and proceeding to and executing step (c3) when it is determined that the measured temperature does not exceed the predetermined target fusing temperature; and (i) when it is determined that the temperature measured in step (g) exceeds the predetermined target fusing temperature, suspending the supply of the source voltage to the heating resistor for the first predetermined time period.

12. A power control apparatus for controlling a roller voltage applied to a heating resistor of an instant heating roller (IHR), comprising:

a power input unit for outputting an external source voltage;

a voltage determination unit for determining a level of the external source voltage from the power input unit, and for outputting a result of the determination;

a temperature measuring unit for measuring a temperature of the heating resistor, and for outputting the measured temperature;

a first comparison unit for comparing the measured temperature with a first predetermined temperature, and for outputting a first comparison result;

a second comparison unit for comparing the measured temperature with a predetermined target fusing temperature, and for outputting a second comparison result;

a controller for outputting a power control signal in response to the first and second comparison results, and the result of the determination from the voltage determination unit; and a power supply unit for supplying the external source voltage from the power input unit as the roller voltage to the heating resistor in response to the power control signal.

13. The power control apparatus of claim 12, further comprising a frequency determination unit for outputting to the controller a signal having a frequency the same as a frequency of the external source voltage from the power input unit, wherein the controller obtains the frequency using the signal output from the frequency determination unit and calculates the first and second predetermined time periods depending on the obtained frequency.

14. The power control apparatus of claim 13, wherein the frequency determination unit comprises:

a level dropping portion for dropping a level of the external source voltage from the power input unit, and for outputting the dropped voltage;

a rectifying portion for rectifying the dropped voltage, and for outputting a rectified result;

a constant-voltage generating portion for generating a constant voltage from the rectified result; and a switching portion for performing on/off switching in response to the constant voltage, and for outputting a result of the switching to the controller;

wherein the controller determines the frequency of the external source voltage from the result of the switching.

15. The power control apparatus of claim 12, wherein the voltage determination unit comprises:

a level dropping portion for dropping the level of the external source voltage from the power input unit, and for outputting the dropped voltage;

a rectifying portion for rectifying the dropped voltage, and for outputting a rectified result;

a voltage dividing portion for dividing a level of the rectified result, and for outputting a signal having a divided level as a comparison signal;

a reference voltage generating portion for generating a reference signal; and a third comparison unit for comparing the reference signal and the comparison signal, and for outputting a comparison result.

16. A power control apparatus for controlling a roller voltage applied to a heating resistor of an instant heating roller (IHR), comprising:

a power input unit for outputting an external source voltage;

a voltage determination unit for determining a level of the external source voltage from the power input unit, and for outputting a result of the determination;

a temperature measuring unit for measuring a temperature of the heating resistor, and for outputting the measured temperature;

a first comparison unit for comparing the measured temperature with a first predetermined temperature, and for outputting a first comparison result;

a second comparison unit for comparing the measured temperature with a second predetermined temperature, and for outputting a second comparison result;

a controller for outputting a power control signal in response to the first and second comparisons results, and the result of the determination from the voltage determination unit; and a power supply unit for supplying the external source voltage from the power input unit as the roller voltage to the heating resistor in response to the power control signal.

17. The power control apparatus of claim 16, further comprising a frequency determination unit for outputting to the controller a signal having the same frequency as the source voltage input through the power input unit, wherein the controller obtains the frequency using the signal output from the frequency determination unit and calculates the third predetermined time period for supply of the external supply voltage depending on the obtained frequency.

18. The power control apparatus of claim 17, wherein the frequency determination unit comprises:

a level dropping portion for dropping a level of the external source voltage from the power input unit, and for outputting the dropped voltage;

a rectifying portion for rectifying the dropped voltage, and for outputting a rectified result;

a constant-voltage generating portion for generating a constant voltage from the rectified result; and a switching portion for performing on/off switching in response to the constant voltage, and for outputting a result of the switching to the controller;

wherein the controller determines the frequency of the external source voltage from the result of the switching.

19. The power control apparatus of claim 16, wherein the voltage determination unit comprises:

a level dropping portion for dropping a level of the external source voltage from the power input unit, and for outputting the dropped voltage;

a rectifying portion for rectifying the dropped voltage, and for outputting a rectified result;

a voltage dividing portion for dividing a level of the rectified result, and for outputting a signal having a divided level as a comparison signal;

a reference voltage generating portion for generating a reference signal; and a third comparison unit for comparing the reference signal and the comparison signal, and for outputting a comparison result.

* * * * *